US008581715B2

(12) United States Patent
Ito et al.

(10) Patent No.: US 8,581,715 B2
(45) Date of Patent: Nov. 12, 2013

(54) EMERGENCY REPORTING APPARATUS

(75) Inventors: Noriaki Ito, Toyota (JP); Hiroshi Sakai, Okazaki (JP)

(73) Assignees: Toyota Jidosha Kabushiki Kaisha, Aichi (JP); Denso Corporation, Aichi (JP)

( * ) Notice: Subject to any disclaimer, the term of this patent is extended or adjusted under 35 U.S.C. 154(b) by 954 days.

(21) Appl. No.: 12/160,390

(22) PCT Filed: Feb. 6, 2007

(86) PCT No.: PCT/JP2007/052047

§ 371 (c)(1),
(2), (4) Date: Jul. 9, 2008

(87) PCT Pub. No.: WO2007/097191

PCT Pub. Date: Aug. 30, 2007

(65) Prior Publication Data

US 2010/0238052 A1 Sep. 23, 2010

(30) Foreign Application Priority Data

Feb. 24, 2006 (JP) ..... 2006-047706

(51) Int. Cl.
*G08B 21/00* (2006.01)

(52) U.S. Cl.
USPC ..... 340/436; 340/438; 340/440; 340/988; 340/989; 369/21; 701/46

(58) Field of Classification Search
USPC ..... 340/988
See application file for complete search history.

(56) References Cited

U.S. PATENT DOCUMENTS

| | | | | |
|---|---|---|---|---|
| 4,143,283 | A * | 3/1979 | Graf et al. | 307/66 |
| 4,992,943 | A * | 2/1991 | McCracken | 701/35 |
| 5,198,811 | A * | 3/1993 | Potter et al. | 340/905 |
| 5,233,337 | A * | 8/1993 | Takahashi | 345/82 |
| 5,311,197 | A * | 5/1994 | Sorden et al. | 342/457 |
| 5,325,082 | A * | 6/1994 | Rodriguez | 340/438 |
| 5,353,023 | A * | 10/1994 | Mitsugi | 340/989 |
| 5,499,182 | A * | 3/1996 | Ousborne | 701/35 |
| 5,589,827 | A * | 12/1996 | Scurati | 340/901 |
| 5,815,093 | A * | 9/1998 | Kikinis | 340/937 |
| 6,185,490 | B1 * | 2/2001 | Ferguson | 701/35 |
| 6,240,346 | B1 * | 5/2001 | Pignato | 701/35 |
| 2002/0035422 | A1 | 3/2002 | Sasaki | |
| 2003/0125853 | A1 | 7/2003 | Takagi et al. | |
| 2003/0125854 | A1 | 7/2003 | Kawasaki et al. | |
| 2003/0154009 | A1 | 8/2003 | Basir et al. | |
| 2003/0163233 | A1 | 8/2003 | Song et al. | |

(Continued)

FOREIGN PATENT DOCUMENTS

| | | | |
|---|---|---|---|
| DE | 102 40 838 | A1 | 3/2004 |
| JP | 05-130545 | A | 5/1993 |
| JP | 06-251292 | A | 9/1994 |
| JP | 08-287386 | A | 11/1996 |
| JP | 11-053280 | A | 2/1999 |
| JP | 2000-013736 | A | 1/2000 |
| JP | 2001-130345 | A | 5/2001 |
| JP | 2001-216588 | A | 8/2001 |
| JP | 2003-293914 | A | 10/2003 |
| JP | 2003-330580 | A | 11/2003 |
| JP | 2003-533389 | A | 11/2003 |
| WO | 98/47109 | A1 | 10/1998 |

*Primary Examiner* — Benjamin C Lee
*Assistant Examiner* — Curtis King
(74) *Attorney, Agent, or Firm* — Sughrue Mion, PLLC

(57) ABSTRACT

An emergency reporting apparatus including an emergency signal outputting part that outputs an emergency signal when a vehicle is in an emergency status and a logic circuit part that stores an emergency signal output by the emergency signal outputting part with a logic circuit. Furthermore, an emergency reporting apparatus conducts an emergency report with respect to the outside based on the emergency signal output from the emergency signal outputting part.

13 Claims, 4 Drawing Sheets

(56) References Cited

U.S. PATENT DOCUMENTS

| | | | | |
|---|---|---|---|---|
| 2004/0122639 | A1 | 6/2004 | Qiu | |
| 2004/0177178 | A1* | 9/2004 | Gregg et al. | 710/52 |
| 2005/0222933 | A1* | 10/2005 | Wesby | 705/36 |
| 2007/0150140 | A1* | 6/2007 | Seymour | 701/35 |
| 2008/0228996 | A1* | 9/2008 | Tan et al. | 711/103 |
| 2009/0027167 | A1* | 1/2009 | Pistor et al. | 340/10.1 |

* cited by examiner

EMERGENCY REPORTING APPARATUS

TECHNICAL FIELD

The present invention relates to an emergency reporting apparatus for reporting an emergency to an information center, for example, when a vehicle is in an emergency status, such as being in an accident.

BACKGROUND ART

Conventionally, there is known a vehicle accident detecting apparatus that stores accident data of accidents in a non-volatile memory and reports the accidents to a center or the like based on the accident data stored in the non-volatile memory (For example, see Patent Document 1).

Patent Document No. 1 Japanese Patent Application No. 2003-533389

DISCLOSURE OF THE INVENTION

Problem to be Solved by the Invention

However, with the conventional vehicle accident detecting apparatus, some amount of time is required for accident data to be written and stored in the non-volatile memory. Therefore, there is a risk that accident data cannot be stored when there is a change or disconnection in the electric power supplied to the apparatus. Therefore, even where a vehicle accident has occurred, there is a risk that the accident information will not be reported to a center.

Accordingly, it is an object of the present invention to solve the foregoing problem, and it is a main object to conduct an emergency report in a case where a vehicle is in an emergency status.

Means for Solving Problem

An embodiment of the present invention for achieving the above-described object is an emergency reporting apparatus including an emergency signal outputting part that outputs an emergency signal when a vehicle is in an emergency state and conducting an emergency report with respect to the outside based on the emergency signal output by the emergency signal outputting part, characterized by having a logic circuit part that stores the emergency signal output by the emergency signal outputting part with a logic circuit.

With this embodiment of the present invention, even in a case where, for example, change or disconnection of supply voltage occurs upon vehicle collision, the logic circuit part surely stores and retains the emergency signal output by the emergency signal outputting part with the logic circuit that can operate at low voltage and conduct a storing process at high speed. Accordingly, the emergency report can be surely conducted when the vehicle is in an emergency status.

Furthermore, in this embodiment of the present invention, the logic circuit part may determine whether to conduct a report with respect to the outside based on the emergency signal stored by the logic circuit.

Moreover, this embodiment of the present invention may further have a non-volatile storing part that stores the emergency signal output by the emergency signal outputting part with a non-volatile memory, wherein the logic circuit part may store the emergency signal at least until a process of storing the emergency signal by the non-volatile storing part is completed. Thereby, even in a case where, for example, change or disconnection of supply voltage occurs upon vehicle collision and the emergency signal is not stored by the non-volatile storing part, the emergency signal can be surely stored and retained by the logic circuit part. Accordingly, the emergency report can be surely conducted when the vehicle is in an emergency status.

This embodiment of the present invention may further have a non-volatile storing part that stores the emergency signal output by the emergency signal outputting part with a non-volatile memory, wherein the logic circuit part may store the emergency signal at least until the non-volatile storing part erases storage of the emergency signal. Thereby, the emergency signal can be stored and retained in at least either one of the non-volatile storing part or the logic circuit part. Accordingly, the emergency report can be surely conducted when the vehicle is in an emergency status.

This embodiment of the present invention may further have an emergency signal determining part that determines whether the emergency signal is stored by the logic circuit part, wherein an emergency report may be conducted with respect to the outside when the emergency signal is determined as being stored by the emergency signal determining part. Thereby, the emergency report can be surely conducted with respect to the outside based on the emergency signal stored by the logic circuit part.

This embodiment of the present invention may further have an emergency signal determining part that determines whether the emergency signal is stored at least by either one of the logic circuit part or the non-volatile storing part at a time of reactivating the apparatus, wherein an emergency report may be conducted with respect to the outside when the emergency signal is determined as being stored by the emergency signal determining part. Thereby, even in a case where, for example, change or disconnection of supply voltage occurs upon vehicle collision and the apparatus being reset is reactivated, the emergency report can be surely conducted with respect to the outside based on the emergency signal stored by at least either one of the logic circuit part or the non-volatile storing part.

This embodiment of the present invention may further have a location detecting part that detects a current location of a vehicle, wherein the logic circuit part may store the current location of the vehicle detected by the location detecting part together with the emergency signal. Thereby, in a case where, for example, change or disconnection of supply voltage occurs upon vehicle collision, information of the current location of the vehicle together with the emergency signal can be surely stored and retained by the logic circuit.

In this embodiment of the present invention, the emergency signal outputting part is, for example, a passenger protecting apparatus for protecting a passenger, wherein the emergency signal is an activation signal output when activating the passenger protecting apparatus.

In this embodiment of the present invention, the passenger protecting apparatus is, for example, an airbag apparatus, wherein the activation signal is an airbag deployment signal.

In this embodiment of the present invention, the emergency status of the vehicle includes, for example, where a vehicle accident has occurred.

In this embodiment of the present invention, the outside is an information center, and may further have a reporting apparatus that conducts the emergency report by transmitting the activation signal to the information center.

In this embodiment of the present invention, the non-volatile memory is, for example, a memory that is electrically erasable and writable.

In this embodiment of the present invention, the logic circuit includes, for example, at least a latch circuit that retains the activation signal and an AND circuit that conducts a determining process based on the activation signal retained by the latch circuit.

In this embodiment of the present invention, the logic circuit is, for example, a logic IC that is operable at a low voltage. Thereby, for example, in a case of vehicle collision, the activation signal, which could not be retained by the CPU conducting a process such as making an emergency report, can be surely retained by the logic IC that is operable at a low voltage.

EXPLANATION OF REFERENCE NUMERALS

Figure 1:
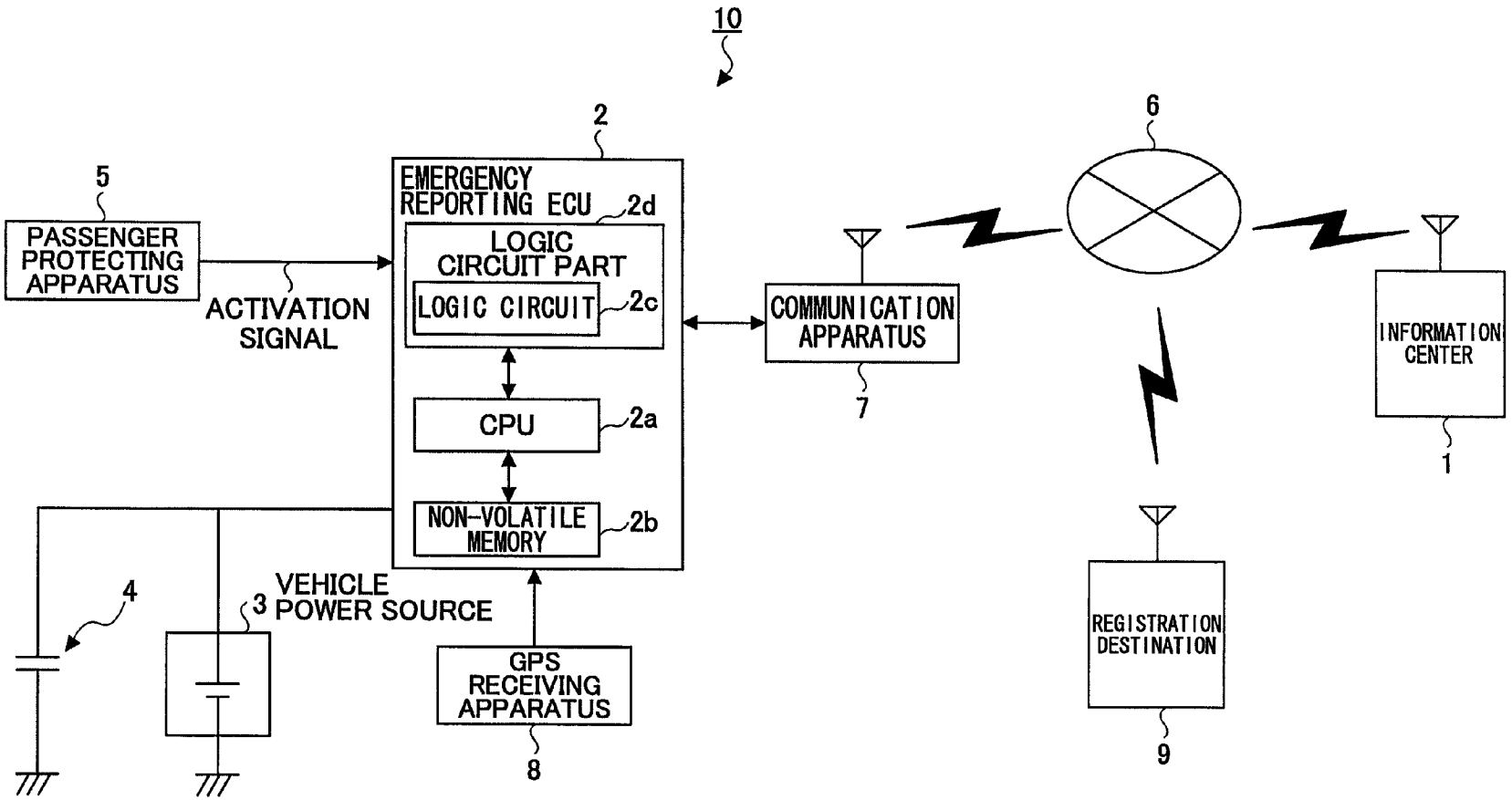
FIG. 1 is a block diagram showing a configuration of a system of an emergency reporting apparatus according to an embodiment of the present invention.

1 information center
2 emergency reporting ECU
2*a* CPU
2*b* non-volatile memory
2*c* logic circuit part
2*d* logic circuit
3 vehicle power source
5 passenger protecting apparatus
8 GPS receiving apparatus
10 emergency reporting apparatus

BEST MODE FOR IMPLEMENTING THE INVENTION

Next, a best mode for implementing the present invention is described by presenting embodiments while referring to the attached drawings.

FIG. 1 is a block diagram showing a configuration of a system of an emergency reporting apparatus according to an embodiment of the present invention. The emergency reporting apparatus 10 according to this embodiment is mounted on a vehicle. For example, in a case where a vehicle is in an emergency status (e.g., vehicle accident, vehicle fire), the emergency reporting apparatus 10 reports an emergency to the outside (e.g., information center).

The emergency reporting apparatus 10 is configured having an emergency reporting ECU (Electronic Control Unit) 2 as its center for executing, for example, a control process of the emergency reporting apparatus 10.

The emergency reporting ECU 2 includes: a CPU (Central Processing Unit) 2*a* for executing various processes in accordance with a control or calculation program along with controlling each part of the emergency reporting apparatus 10; a non-volatile memory 2*b* for storing data processed by the CPU 2*a* and rewriting data; and a logic circuit part 2*d* for performing, for example, a storing process, a calculating process, or a determining process on various data by using a logic circuit 2*c*.

For example, EPROM (Erasable Programmable ROM: Flash ROM), or EEPROM (Electrically EPROM) is used as the non-volatile memory 2*b*.

The logic circuit part 2*d* performs a storing process, a calculating process, or a determining process on digital signals by using the logic circuit 2*c*. The logic circuit 2*c* is configured having, for example, plural transistors, diodes, and resistors. A programmable logic IC (Integrated Circuit) is used as the logic circuit 2*c*. It is to be noted that the logic circuit 2*c* can perform the storing process at an extremely high speed by electrically latching the signals. Furthermore, since the logic circuit 2*c* can perform the storing process using small electric current, the logic circuit 2*c* can retain storage for a long period.

A vehicle power source 3 is connected to the emergency reporting ECU 2 for supplying power to the emergency reporting ECU 2. Furthermore, a condenser 4 is connected to the emergency reporting ECU 2 in parallel with the vehicle power source 3.

A passenger protecting apparatus 5 is connected to the emergency reporting ECU 2 for protecting a passenger. The passenger protecting apparatus 5 is activated and outputs an activation signal to the emergency reporting ECU 2 in a case of protecting a passenger.

The emergency reporting ECU 2 recognizes that a vehicle is in emergency status, for example, upon receiving an activation signal from the passenger protecting apparatus 5. It is to be noted that a vehicle being in an emergency status refers to, for example, a case where a vehicle accident has occurred (e.g., a vehicle colliding with an obstacle).

The passenger protection apparatus 5 includes, for example, a seatbelt apparatus for confining a passenger to a seat of a vehicle, an airbag apparatus for deploying and inflating an airbag for absorbing shock applied to a passenger, a steering apparatus having a shock absorption mechanism installed in a steering column, a brake pedal apparatus for averting upon generation of shock and absorbing the shock, a PCS (Pre Crush Safety) control apparatus and any other apparatus for ensuring safety of the vehicle.

For example, in a case where an acceleration sensor or the like detects shock of the vehicle, the airbag apparatus being the passenger protecting apparatus 5 is activated to deploy the airbag and output an airbag deployment signal that is the activation signal to the emergency reporting ECU 2. It is to be noted that the airbag deployment signal comprises, for example, serial digital data.

The activation signal transmitted from the passenger protecting apparatus 5 is, first, stored and retained in the logic circuit 2*c* of the logic circuit part 2*d* of the emergency reporting ECU 2. Furthermore, the activation signal is transmitted from the logic circuit 2*c* to the CPU 2*a*. The CPU 2*a* performs writing and storing in the non-volatile memory 2*b* based on the received activation signal.

It is to be noted that, as described above, the storing process of the logic circuit part 2*d*, as described above, is performed at an extremely high speed compared to the storing process of the non-volatile memory 2*b* (e.g., requiring several tens milliseconds for writing data). Therefore, the logic circuit part 2*d* completes the process of storing the activation signal before the non-volatile memory 2*b* completes the process of storing the same activation signal.

Furthermore, the logic circuit part 2*d* is configured to store and retain the activation signal at least until the process of storing the activation signal is completed by the non-volatile memory 2*b*. Thereby, in a case where, for example, disconnection of the vehicle power source 3 causes an interruption in the process of storing the activation signal by the non-volatile memory 2*b*, the same activation signal can be surely stored and retained by the logic circuit part 2*d*.

A communication apparatus 7, which performs data reception and transmission with the outside (e.g., information center 1), is connected to the emergency supporting ECU 2 via a communication network 6. It is to be noted that the communication network 6 includes, for example, a regular telephone network, a mobile telephone network, and the Internet. The mobile telephone network includes, for example, a communication base station.

The emergency supporting ECU 2 reports an emergency by transmitting an activation signal of the passenger protecting apparatus 5 to, for example, the information center 1 via the communication apparatus 7 and the communication network 6. It is to be noted that the emergency supporting ECU 2 may be connected to a GPS (Global Positioning System) receiving apparatus 8 for detecting a vehicle's current location. The GPS receiving apparatus 8 transmits detected location information regarding the current location of a vehicle (e.g., address, telephone number, latitude, longitude) to the emergency supporting ECU 2. In this case, the non-volatile memory 2*b* and the logic circuit part 2*d* of the emergency supporting ECU 2 may store the location information of the vehicle together with the activation signal. Then, the emergency supporting ECU 2 transmits the location information of the vehicle together with the activation signal to the information center 1 via the communication apparatus 7 and the communication network 6. Thereby, the information center 1 can recognize that the vehicle is in an emergency state along with recognizing the current location of the vehicle. Accordingly, precise and swift action can be taken in response to the vehicle being in an emergency status.

The GPS receiving apparatus 8 performs calculations and detects location information regarding the current location of a vehicle based on positioning radio waves from plural GPS satellites. Furthermore, the location information may be detected from a navigation apparatus mounted on the vehicle or a GPS receiver built inside a mobile phone of the user.

The information center 1 recognizes that the vehicle having the emergency reporting apparatus 10 mounted thereon is in an emergency status when receiving an activation signal of the passenger protecting apparatus 5 from the emergency supporting ECU 2. Then, the information center 1, based on the received activation signal and location information of the vehicle, reports the emergency status of the vehicle to a registration destination 9 registered beforehand, such as a police department, a fire department, or the residence of the user. Thereby, emergency actions such as passenger rescue can be swiftly and surely performed for the vehicle having the emergency reporting apparatus 10 mounted thereon.

Furthermore, based on the activation signal, the location information of the vehicle, and pre-registered information (e.g., emergency contact address), the emergency supporting ECU 2 may be configured to directly report the emergency to the registration destination 9 (e.g., police department, fire department, user's residence) without the intervention of the information center 1.

Furthermore, the CPU 2*a* of the emergency reporting ECU 2 may erase the memory of the activation signal from the non-volatile memory 2*b* and the logic circuit 2*c* of the logic circuit part 2*d* when determining that the reporting of the emergency has been completed by the communication apparatus 7. This surely prevents erroneous reports after the completion of the emergency report.

It is to be noted that there may be a case where the CPU 2*a* of the emergency reporting ECU 2 is reset by, for example, disconnection of the vehicle power source 3. In this case, if the CPU 2*a* determines that an activation signal is stored and retained in either one of the non-volatile memory 2*b* and the logic circuit 2*c* of the logic circuit part 2*d* upon re-activation, the activation signal is transmitted to the information center 1 via the communication apparatus 7. Thereby, emergency can be reported more surely.

Next, an example of a configuration of the logic circuit 2*c* of the logic circuit part 2*d* is described in detail.

Figure 2:
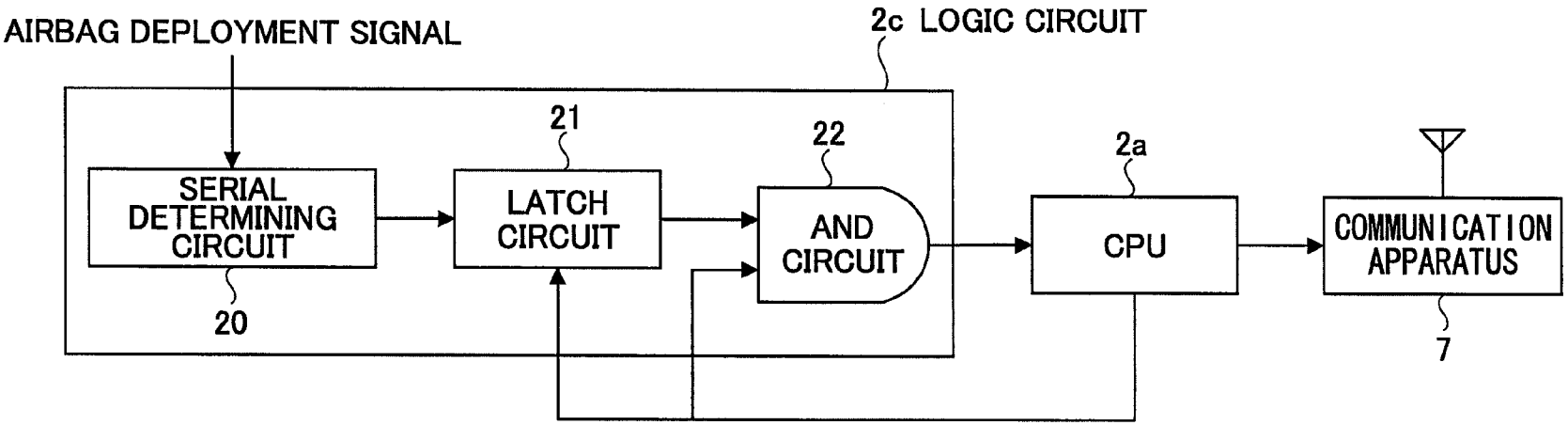
FIG. 2 is a diagram showing an example of a configuration of a logic circuit of a logic circuit part.

For example, as shown in FIG. 2, the logic circuit 2*c* includes a serial determination circuit 20 for extracting specific data (e.g., the value of the $3^{rd}$ bit=1) from an airbag deployment signal comprising serial data transmitted from the airbag apparatus (passenger protecting apparatus) 5, a latch circuit 21 for retaining the specific data (value of $3^{rd}$ bit=1) extracted by the serial determination circuit 20, and an AND circuit 22 for performing a determination process using logical conjunction based on the specific data (value of $3^{rd}$ bit=1) stored and retained by the latch circuit 21 and, for example, a signal input from the CPU 2*a* (See FIG. 2).

It is to be noted that the CPU 2*a* may input a signal=1 to the AND circuit 22 immediately after detecting a vehicle speed with a vehicle speed sensor for preventing erroneous reporting by the emergency reporting apparatus 10.

The CPU 2*a*, upon receiving a value=1 from the AND circuit 22 of the logic circuit 2*c*, transmits an activation signal to the information center 1 via the communication apparatus 7 and the communication network 6. It is to be noted that the configuration of the logic circuit 2*c* is one example, and other arbitrary circuit configurations may be applied as long as the configuration has the above-described functions.

Figure 3:
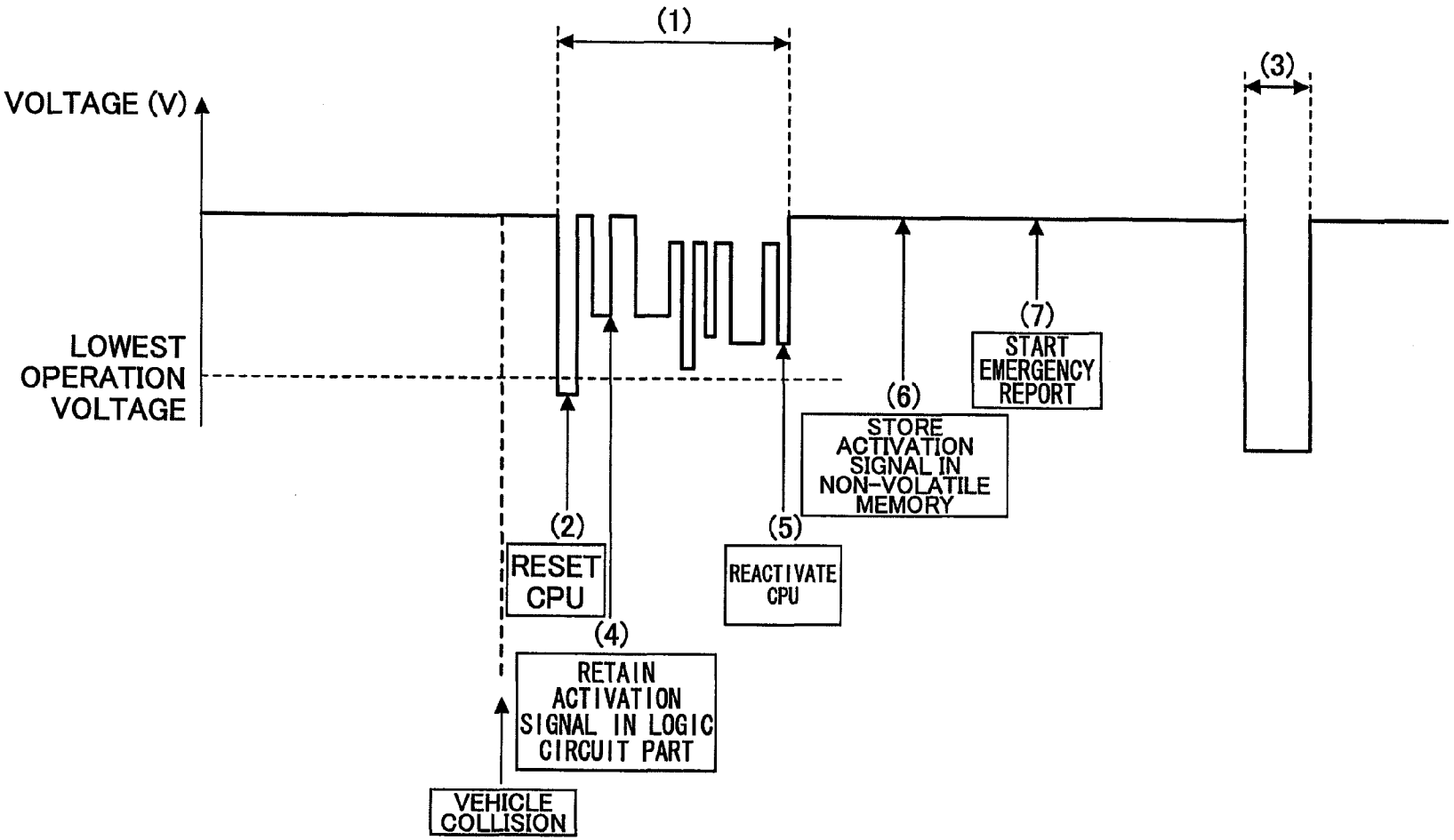
FIG. 3 is a diagram showing, in chronological order, an example of changes of supplied voltage supplied from an emergency reporting ECU 2 from the time of vehicle collision.

FIG. 3 is a diagram showing, in chronological order, an example of changes of supplied voltage supplied from an emergency reporting ECU 2 from the time of vehicle collision.

As shown in FIG. 3, in a case of a vehicle accident (e.g., a case where a vehicle collides with an obstacle), various fuses of the vehicle melt to change the voltage of the power source of the vehicle. This change of voltage causes the supply voltage supplied to the emergency supporting ECU 2 to change (1). In some cases, the supply voltage becomes lower than the least operation voltage necessary for operating the emergency supporting ECU 2 (2). In other cases the supply voltage becomes disconnected (3).

Accordingly, the CPU 2*a* of the emergency reporting ECU 2 is reset, to thereby lead to a risk of interrupting each process in the emergency reporting ECU 2. Furthermore, the phenomena such as the change or disconnection of power supply occur in a short period such as immediately after collision of the vehicle. Therefore, as described above, the process of storing an activation signal transmitted from the passenger protecting apparatus 5 being performed by the non-volatile memory 2*b* of the emergency reporting ECU 2 may be interrupted before the process is completed, thereby leading to a risk of being unable to store the activation signal in the non-volatile memory 2*b*.

In such a case, with the conventional art, there is a risk of the emergency not being reported when the emergency reporting ECU is reactivated since the activation signal, which should have be stored in the non-volatile memory, is not stored.

In contrast, the emergency reporting ECU 2 of the emergency reporting apparatus 10 according to an embodiment of the present invention stores and retains the activation signal transmitted from the passenger protecting apparatus 5 in the logic circuit 2*c* of the logic circuit part 2*d* operating at low voltage and being capable of performing a storing process at high speed. Then, the CPU 2*a* writes and stores the activation signal in the non-volatile memory 2*b*.

Accordingly, even in a case of being unable to store an activation signal in the non-volatile memory 2*b* of the emergency reporting ECU 2, the same activation signal can be surely stored and retained by the logic circuit 2*c* of the logic circuit part 2*d*. Therefore, the CPU 2*a* of the emergency reporting ECU 2 can surely report emergencies to the information center 1 based on the activation signal stored and retained in the logic circuit 2*c* of the logic circuit part 2*d*.

Figure 4:
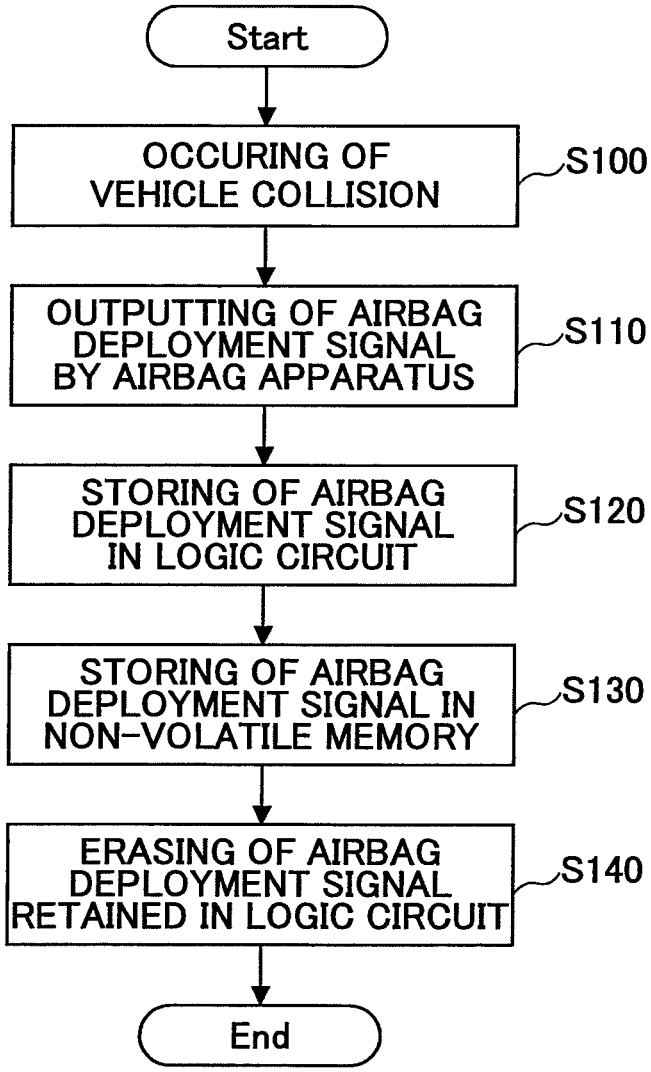
FIG. 4 is a flowchart showing a flow of control processes of an emergency reporting apparatus according to an embodiment of the present invention.

Next, a flow of control processes of the emergency reporting apparatus according to an embodiment of the present invention is described in detail. FIG. 4 is a flowchart showing a flow of control processes of an emergency reporting apparatus 10 according to an embodiment of the present invention.

For example, when a vehicle collision occurs (S100), the airbag apparatus 5 is activated in accordance with the shock detected by an acceleration sensor activated so as to deploy an airbag and protect the passenger. At this instant, the airbag apparatus 5 outputs an airbag deployment signal to the emergency reporting ECU 2 (Step S110).

The airbag deployment signal transmitted from the airbag apparatus 5 and received, by the emergency reporting ECU 2 is stored and retained in the logic circuit 2*c* of the logic circuit part 2*d* (S120). Thus, even in a case where the CPU 2*a* is reset due to a change of supply voltage to the emergency reporting ECU 2 ((2) in FIG. 3), the logic circuit 2*c* of the logic circuit part 2*d* surely stores and retains the airbag deployment signal without being affected by the change of supply voltage ((4) in FIG. 3) since the logic circuit 2*c* of the logic circuit part 2*d* operates at low voltage and is capable of performing a storing process at high speed.

Furthermore, when the supply voltage to the emergency reporting ECU 2 becomes steady and reaches a value which is no less than a predetermined value, the CPU 2*a* is reactivated by performing, for example, an initial operation ((5) of FIG. 3). The reactivated CPU 2*a* causes the non-volatile memory 2*b* to store the airbag deployment signal based on the airbag deployment signal stored in the logic circuit 2*c* of the logic circuit part 2*d* (S130).

When the CPU 2*a* determines that the process of storing the airbag deployment signal ((6) of FIG. 3) has been completed by the non-volatile memory 2*b*, the CPU 2*a* erases the airbag deployment signal stored and retained in the logic circuit 2*c* of the logic circuit part 2*d* (e.g., resetting a signal retained in the latch circuit 21 and changing the retained value from 1 to 0) (S140).

Then, the CPU 2*a* of the emergency reporting ECU 2 starts an emergency report by transmitting an airbag deployment signal to the information center 1 via the communication apparatus 7 and the communication network 6 ((7) of FIG. 3).

It is to be noted that, even in a case where disconnection of the vehicle power source occurs after the emergency reporting ECU 2 has starting the emergency report ((3) of FIG. 3), the reactivated CPU 2*a* can surely resume the emergency report by reading out the airbag deployment signal stored and retained in either the non-volatile memory 2*b* or the logic circuit 2*c* of the logic circuit part 2*d*.

As described above, with the emergency reporting apparatus 10 according to an embodiment of the present invention, the emergency reporting ECU 2 stores and retains the activation signal transmitted from the passenger protecting apparatus 5 in the logic circuit 2*c* of the logic circuit part 2*d*. Then, the same activation signal is written and stored in the non-volatile memory 2*b* by the CPU 2*a*.

Thereby, even in a case where an activation signal cannot be stored in the non-volatile memory 2*b* of the emergency reporting ECU 2 due to change or disconnection of the above-described supply voltage caused by, for example, a vehicle collision, the same activation signal can be surely stored and retained in the logic circuit 2*c* of the logic circuit part 2*d*. Therefore, the CPU 2*a* of the emergency reporting ECU 2 can surely conduct an emergency report with respect to the information center 1 based on the activation signal stored and retained in the logic circuit 2*c* of the logic circuit part 2*d*.

The present invention is not limited to the embodiments explained heretofore, but various variations and modifications may be made without departing from the scope of the invention.

For example, according to an embodiment of the present invention, collision of a vehicle may be estimated based on a signal from a vehicle sensor mounted on the vehicle such as acceleration of the vehicle detected by an acceleration sensor, speed of the vehicle detected by a vehicle speed sensor, or an image taken by a camera. More specifically, the emergency reporting ECU 2 may further include a collision determining part for determining collision of a vehicle based on signals from these vehicle sensors, so that signals regarding collision determined by the collision determining part are input to the serial determining circuit 20 of the logic circuit 2*c* of the logic circuit part 2*d* and retained in the latch circuit 21.

Although the logic circuit part 2*d* is installed in the emergency reporting ECU 2 in the above-described embodiment of the present invention, the logic circuit part 2*d* may be configured in a manner provided outside of the emergency reporting ECU 2.

INDUSTRIAL APPLICABILITY

The present invention can be used for an emergency reporting apparatus that reports to an information center, for example, in a case where a vehicle accident occurs. There is no limitation on the appearance, weight, size, or running performance of the vehicle to which the emergency reporting apparatus is mounted.

The present application is based on Japanese Priority Application No. 2006-047706 filed on Feb. 24, 2006, with the Japanese Patent Office, the entire contents of which are hereby incorporated by reference.

The invention claimed is:

1. An emergency reporting apparatus including an emergency signal outputting part that outputs an emergency signal when a vehicle is in an emergency status and conducting an emergency report with respect to the outside based on the emergency signal output by the emergency signal outputting part, the emergency reporting apparatus comprising:

a logic circuit part that stores the emergency signal output by the emergency signal outputting part with a logic circuit; and a non-volatile storing part that stores the emergency signal output by the emergency signal outputting part with a non-volatile memory;

wherein the logic circuit is a logic IC that is operable at a low voltage and that stores the emergency signal status when a central processing unit of the emergency reporting apparatus is not operational;

wherein the low voltage is lower than a least operation voltage that is necessary for operating the central processing unit of the emergency reporting apparatus;

wherein the central processing unit controls writing of the emergency signal to the non-volatile storing part when a voltage supplied to the central processing unit is above the operation voltage of the central processing unit, based on the availability of the emergency signal from the emergency signal outputting part or the logic circuit;

wherein the central processing unit is configured to determine whether the storing of the emergency signal in the non-volatile memory is completed by the non-volatile storing part; and wherein the logic circuit part, the central processing unit and the non-volatile storing part are all included in an emergency reporting electronic control unit of the emergency reporting apparatus, the emergency reporting apparatus further comprising:

a communication apparatus connected to the emergency reporting electronic control unit and configured to report the emergency status using the stored emergency signal stored in the non-volatile storing part in a case where the central processing unit determines that the storing of the emergency signal is completed by the non-volatile storing part, even at a time when the central processing unit is reset.

2. The emergency reporting apparatus as claimed in claim 1, further comprising:

a location detecting part that detects a current location of the vehicle;

wherein the logic circuit part stores the current location of the vehicle detected by the location detecting part together with the emergency signal.

3. The emergency reporting apparatus as claimed in claim 1, wherein the emergency signal outputting part is a passenger protecting apparatus for protecting a passenger, and in that the emergency signal is an activation signal output when activating the passenger protecting apparatus.

4. The emergency reporting apparatus as claimed in claim 3, wherein the passenger protecting apparatus is an airbag apparatus, and in that the activation signal is an airbag deployment signal.

5. The emergency reporting apparatus as claimed in claim 1, wherein the emergency status of the vehicle includes a state where a vehicle accident has occurred.

6. The emergency reporting apparatus as claimed in claim 3, wherein the outside is an information center, and further comprising:

a reporting apparatus that conducts the emergency report by transmitting the activation signal to the information center.

7. The emergency reporting apparatus as claimed in claim 1, wherein the non-volatile memory is a memory that is electrically erasable and writable.

8. The emergency reporting apparatus as claimed in claim 1, wherein the logic circuit includes at least a latch circuit that retains the emergency signal and an AND circuit that conducts a determining process based on the emergency signal retained by the latch circuit.

9. The emergency reporting apparatus as claimed in claim 1, wherein the central processing unit determines whether to conduct a report with respect to the outside based on the emergency signal stored by the logic circuit.

10. The emergency reporting apparatus as claimed in claim 1, wherein the logic circuit part stores the emergency signal at least until a process of storing the emergency signal by the non-volatile storing part is completed.

11. The emergency reporting apparatus as claimed in claim 9, wherein the logic circuit part stores the emergency signal at least until the non-volatile storing part erases storage of the emergency signal.

12. The emergency reporting apparatus as claimed in claim 10, further comprising:

an emergency signal determining part that determines whether the emergency signal is stored at least by either one of the logic circuit part or the non-volatile storing part at a time of reactivating the apparatus;

wherein the emergency report is conducted with respect to the outside when the emergency signal is determined as being stored by the emergency signal determining part.

13. The emergency reporting apparatus as claimed in claim 10, wherein the non-volatile memory is a memory that is electrically erasable and writable.

* * * * *